United States Patent [19]

Song

[11] Patent Number: 4,927,378

[45] Date of Patent: May 22, 1990

[54] LEAD WIRE CONNECTING DEVICE FOR COAXIAL CABLE CONNECTOR

[76] Inventor: Jae C. Song, 295-9, Jangan-1 Dong, Dongdaemoon-Ku, Seoul, Rep. of Korea

[21] Appl. No.: 290,460

[22] Filed: Dec. 27, 1988

[30] Foreign Application Priority Data

Dec. 23, 1987 [KR] Rep. of Korea ..... 22863/1987

[51] Int. Cl.[5] ..... H01R 4/24

[52] U.S. Cl. ..... 439/394

[58] Field of Search ..... 439/389–426

[56] References Cited

U.S. PATENT DOCUMENTS

| | | | |
|---|---|---|---|
| 2,694,182 | 11/1954 | Edlen et al. | 439/394 |
| 4,261,632 | 4/1981 | Narozny | 439/394 |
| 4,403,820 | 9/1983 | Rich | 439/394 |
| 4,708,414 | 11/1987 | Lam | 439/394 |

*Primary Examiner*—Joseph H. McGlynn

*Attorney, Agent, or Firm*—Ostrolenk, Faber, Gerb & Soffen

[57] ABSTRACT

A lead wire connecting device for coaxial cable connector which a core wire and a shield wire are allowed respectively to connect and contact simply and easily to each contact terminal of a hot side pin and a shield side spring of the connector, and which is characterized by that a contacting groove which a core wire is to be inserted is formed at the hot side pin terminal, the contacting spikes which are to be contacted to a shield wire are formed a the tip of the shield side spring terminals, a pinching piece for bending and pressing the core wire to the contacting terminal is formed to the interior of a cover, and a pressing piece for pressing the coaxial cable to the contacting spikes is also formed on a cover, so that the positive contact between cable and an appliance can be obtained without any cumbersome stripping and soldering works as usual.

11 Claims, 3 Drawing Sheets

FIG,1

FIG,3
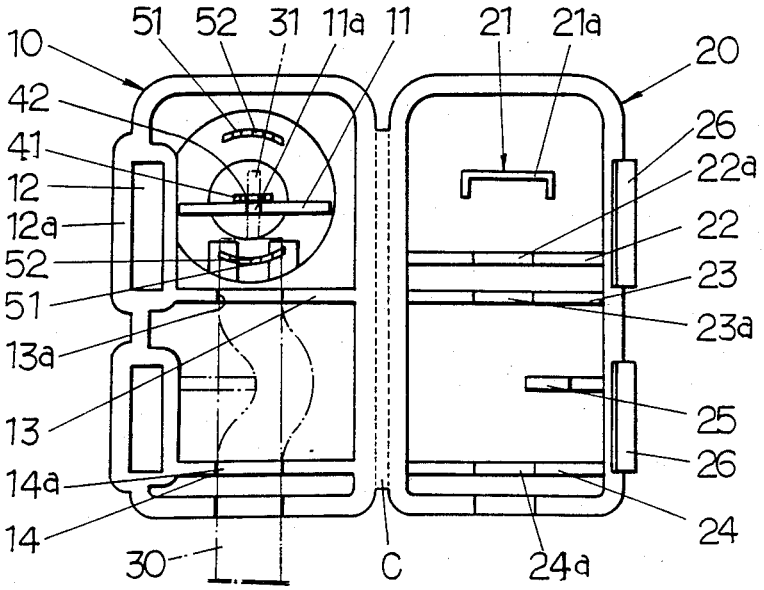
FIG,4
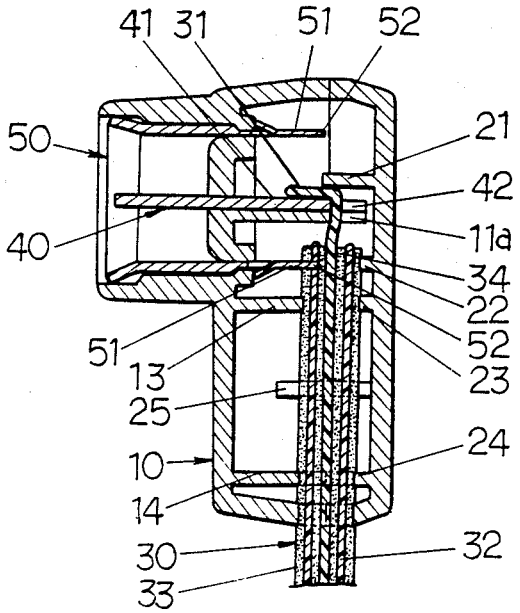

LEAD WIRE CONNECTING DEVICE FOR COAXIAL CABLE CONNECTOR

BACKGROUND OF THE INVENTION

The present invention, for example, in a connector for coaxial cable which is utilized for connecting and contacting a coaxial cable used for connecting an antenna wire of a television of community receiving system or VCR and television set, relates to a lead wire connecting device for coaxial cable which a core wire and a shield wire are allowed respectively to connect and contact readily and simply to each contact terminal of a hot side pin and a shield side spring of said connector.

A conventional connector for coaxial cable generally utilized is provided in usual with a contact terminal of a hot side pin by protruding at a central axis at a part of interior of connector device main body covered with a cover, both contacting terminals of shield side spring are arranged also at its exterior, and the lead wires, i.e., a core wire and a shield wire are respectively connected to each of the contact terminals.

However, heretofore in connecting the coaxial cable to each contact terminal of said connector, an outer covering of cable and shield wire as well as inner insulating material are respectively stripped and a core wire of its central axis and shield wire are bared by predetermined lengths respectively, thereafter said core wire and shield wire have been fixed by soldering to each contact terminal.

Therefore, according to the conventional cable connecting method as above, since it is required to a soldering work and a stripping work of hard and cumbersome to fix by welding respectively the stripped core wire and shield wire after stripping one by one said outer covering and shield wire as well as inner insulating material, there has been the problems that a productivity of the product is remarkably lowered and the manufacturing cost is raised.

SUMMARY OF THE INVENTION

The present invention is invented by aiming to solve various defects and problems which conventional coaxial cable connector includes, which is comprised of such that the contacting spikes are formed, which penetrate into the outer covering of coaxial cable and are contacted to the shield wire of its interior, at the contact terminals of shield side spring arranged at the interior of a connector main body, and a contacting groove is formed which a core wire of coaxial cable is inserted at a contacting terminal of hot side pin, while a pinching piece is formed at the center position of upper interior portion of a cover to be coupled to its connector device main body, which renders to closely contact the end of a core wire inserted to the contacting groove of contacting terminal of said hot side pin by bending it to the contacting terminal and the pressing pieces are formed at the middle portion of said cover's interior which render to press said coaxial cable, so that the contact between the shield side spring and a shield wire and the close contact between a hot side pin and a core wire can be obtained when an opened cover is coupled by closing it in a state that only a core wire of coaxial cable is bared.

BRIEF DESCRIPTION OF THE DRAWINGS

FIG. 3 is a plane view illustrating the connector by developing according to the present invention.

FIG. 4 is a longitudinal cross-sectional view showing the assembled state of the connector according to the present invention.

DETAILED DESCRIPTION OF THE INVENTION

Figure 2:
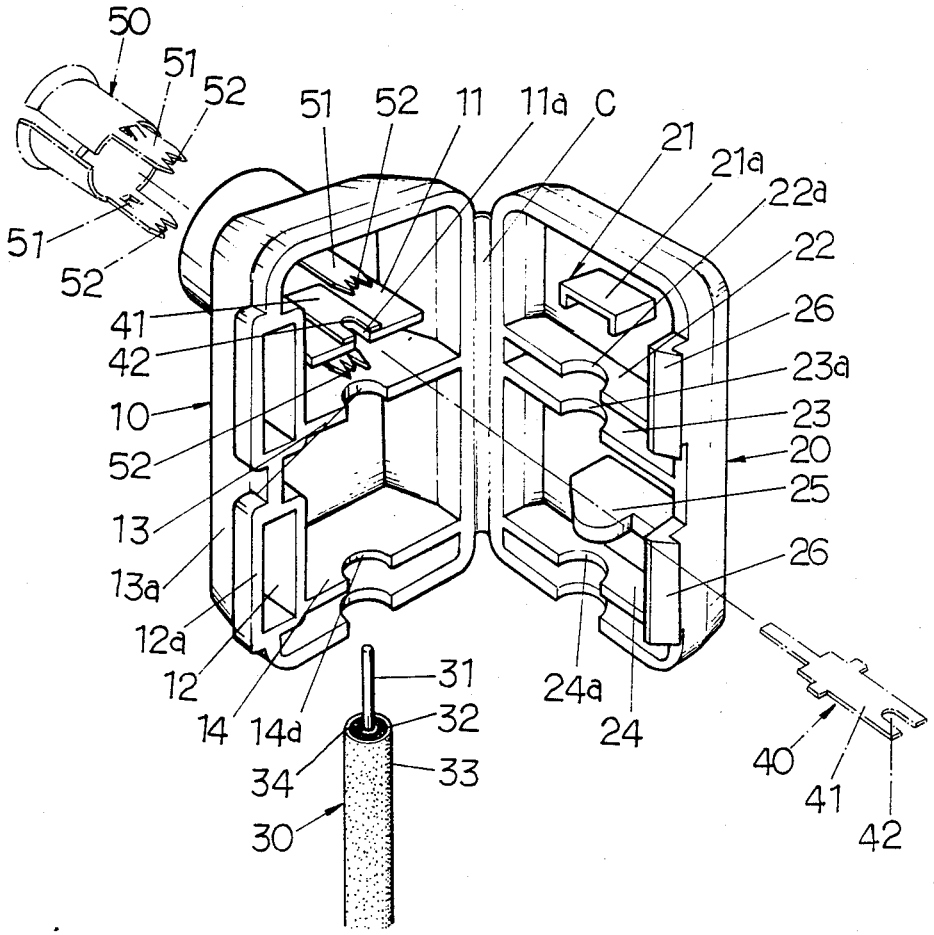
FIG. 2 is a perspective view illustrating the internal configuration by developing the connector according to the present invention.

As shown in FIGS. 2 to 4, in a coaxial cable connector which a contacting terminal 41 of a hot side pin 40 is fixed at a center of upper interior portion of a connector main body 10 which a cover will be covered and coupled, and contacting terminals 51, 51 of a conductive sleeve or shield side spring 50 are fixed at its external portion by a bared condition which a shield wire of coaxial cable is to be contacted, a contacting groove 42 is formed which is cut out by a predetermined depth at an end of the contacting terminal 41 of said hot side pin 40, and a few spearhead type contacting spikes 52 are formed at an end of contacting terminals 51, 51 of said shield side spring 50, at the same time, a supporting piece 11 having supporting groove lla corresponding to a contacting groove 42 of contacting terminal 41 is formed by protruding from the connector main body 10 so as to be contiguous to said contacting terminal 41 at one side surface of said hot side pin contacting terminal 41, a pinching piece 21 bent with "⌐" shape is formed by protruding at the center position of upper portion of internal surface of said cover 20 so that a linear portion 21*a* of said pinching piece 21 is formed to be contiguous in parallel with the end surface of the contacting terminal 41 of said hot side pin 40 fixed at said connector main body 10, and two pressing pieces 22, 23 which the pressing grooves 22*a*, 23*a* pressing the outer covering of cable 30 are formed respectively at the center end portion are formed in parallel each other between both side walls of said cover 20 and at the middle portion of internal surface of thus structured cover 20 so that a pressing groove 22*a* of one of said pressing piece 22 is arranged at an opposite location against the contacting spikes at the end of internal contacting terminal 51 of said shield side spring 50.

On the other hand, thus structured connector device main body 10 and cover 20 are connected by connecting piece (C) with their one side walls, so that the main body 10 and the cover 20 can be opened or closed by turning around said connecting piece (C), at the same time, coupling holes 12 having the hooking walls 12*a* are formed at the opposite edge portion of said connecting piece (C) location in opposite to the snap-in protrusions 26, 26 of the cover so that the assembled state can be firmly kept in accordance with the coupling of a connector device main body 10 and a cover 20.

Figure 1:
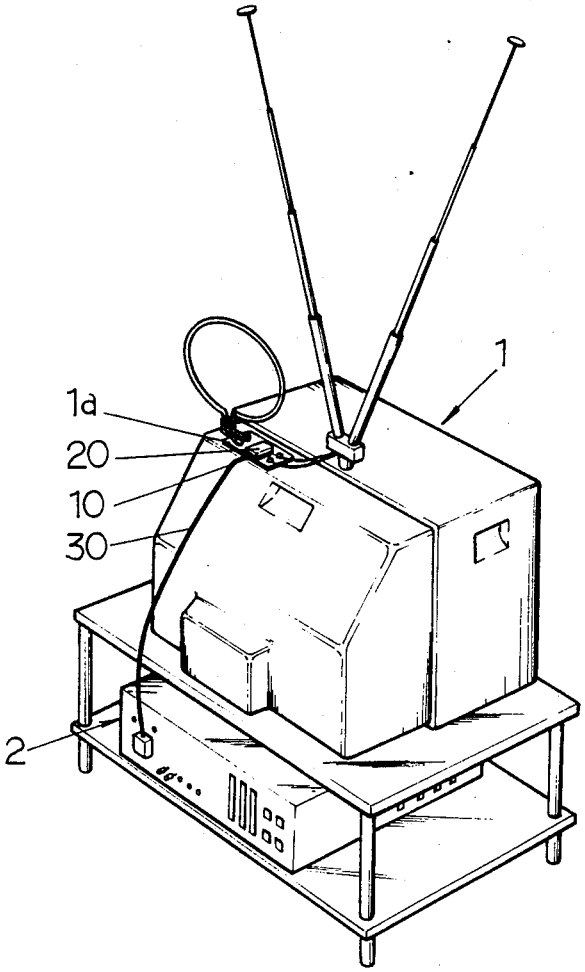
FIG. 1 is a perspective view illustrating the utilizing example of a connector according to the present invention.

In the drawings, the reference numerals 13 and 13*a* are a pressing piece and a pressing groove formed oppositely to said pressing piece 23 at a middle portion of interior of said connector device main body 10, 14, 14*a* and 24, 24*a* are the pinching pieces and the pinching grooves formed oppositely each other at the inducing portion of coaxial cable 30 on the interior surface of each connector device main body 10 and a cover 20, and the numeral 25 is a pushing piece which is fixed in parallel at a side portion between the pinching piece 24 and the pressing piece 23 of said cover 20 so that it supports the coaxial cable 30 to be bent and transformed by pushing it from sideward. In addition, the numerals 33 and 34 are an outer covering and an internal insulation, material of coaxial cable 30, and 1*a* of FIG. 1 is an antenna terminal of television set 1 that a connector of the present invention is connected and contacted, and the 2 is a VCR, respectively.

The operation and effect of a coaxial cable connector according to the present invention will be explained in detail as follows.

In order to connect and contact a coaxial cable 30 to a connector device according to the present invention, firstly as shown in FIGS. 2 and 3, a connector device main body 10 and a cover 20 are to be opened, the end portion of outer covering 33, shield wire 32 and internal insulation material 34 of coaxial cable 30 are to be stripped by a predetermined length and the core wire 31 is allowed to bare by a predetermined length, thereafter a side circumferential surface of connecting end portion of said coaxial cable 30 is inserted through the pressing groove 13*a* and pinching groove 14*a* formed at the pressing piece 13 and pinching piece 14 of said connector device main body 10 so as to be put on said covering end portion to a contacting spike 52 of the tip of contacting terminal 51 of said shield side spring 50, at the same time, an end portion of stripped core wire 31 is allowed to locate so as to be supported over within a contacting groove 42 of contacting terminal of said hot side pin 40 through the supporting groove ll*a* of said supporting piece 11.

After thus made, when the opened cover 20 is covered and said cover 20 is pressed and then a connector device main body 10 and a cover 20 are so coupled that the snap-in protrusions 26 formed at the free end portion of a cover 20 are to be hooked up to the hooking walls 12*a* of said connector device main body 10, since the pressing groove 22*a* of cover side pressing piece 22 formed oppositely against the contacting terminal 51 of said shield side spring 50 becomes to press strongly the outer covering end portion of the coaxial cable 30, the contacting spikes 52 of contacting terminal 51 penetrate into the outer covering of the coaxial cable 30, that is, outer covering 33 portion by the pressing power so that it becomes to contact to the shield wire 32 of its interior, and almost simultaneously with this, a linear portion 21*a* of pinching piece 21 formed on the interior surface of a cover 20 presses and renders to bend the core wire 31 end portion being put over the contacting groove 42 of contacting terminal 41 of said hot side pin 40, so that said bent end portion becomes to contact closely to the contacting terminal 41 as shown in FIG. 4.

Further, since thus the contact of the core wire 31 and the shield wire 32 is completed and also the coaxial cable 30 is bent curvedly by a pushing piece 25 formed at one side of interior surface of said cover 20, at the same time the outer covering portion of coaxial cable 30 inserted to the grooves 13*a*, 14*a* of pressing piece 13 and pinching piece 14 of connector device main body 10 is pressed and then fixed firmly by each pressing groove 23*a* and pinching groove 24*a* of pressing piece 23 and pinching piece 24 formed at inner and outer side thereof, the contact and fixation of coaxial cable as shown in FIG. 4 become to obtain readily and simply.

The present invention as described above, in connecting and contacting the core wire and shield wire of the coaxial cable to each of terminals o hot side pin and shield side spring of a coaxial cable connector connected and contacted with a terminal socket of appliance, since a contacting groove and the contacting spikes are respectively formed at each of the contacting terminal ends of hot side pin and shield side spring arranged within an interior surface of said connector device main body, and the pressing piece and pinching piece corresponding to said contacting groove and contacting spikes are respectively formed within an interior surface of a cover to be coupled to cover with said connector device main body, so that it is comprised so as to be able to obtain the close connection and contact between a hot side pin and a cable core wire and between a shield side spring and a cable shield wire in accordance to the coupling of connector device main body and a cover, the hard and cumbersome connecting and contacting works are eliminated such as a stripping work for the outer covering portion of shield wire as usual and the soldering work between each contacting terminal and core wire and a shield wire, therefore there is the effect that the manufacturing cost is remarkably saved and the productivity is outstandingly enhanced.

What is claimed is:

1. A connector for electrically connecting a coaxial cable to an appliance, said connector comprising:

a conductive pin for electrically connecting an exposed end of a core wire of the coaxial cable to the appliance, said pin having an inner end for contacting the exposed end of the core wire;

a conductive sleeve for electrically connecting a shield wire of the coaxial cable to the appliance, said sleeve surrounding said pin, said sleeve having a conductive spike for piercing through an outer layer of insulation to contact the shield wire of the coaxial cable; and a pinching piece for cooperating with said inner end of said pin to bend the exposed end of the core wire between said pinching piece and said inner end of said pin.

2. The connector of claim 1, further comprising a covered housing, said inner end, said spike, and said pinching piece being located within said housing.

3. The connector of claim 2, wherein said housing includes a body and a cover which is hinged to said body, said pin and said sleeve being connected to said body, said pinching piece being connected to said cover.

4. The connector of claim 3, wherein said cover includes snap-in protrusions for connecting said cover to said body.

5. The connector of claim 3, wherein said inner end of said pin includes a groove for contacting the exposed end of the core wire.

6. The connector of claim 3, further comprising a pressing groove for cooperating with said spike, said pressing piece being connected to said cover.

7. The connector of claim 6, wherein said sleeve includes a second conductive spike for piercing through the outer layer of insulation to contact the shield wire.

8. The connector of claim 7, wherein said sleeve is formed in one piece.

9. A coaxial cable in combination with a connector for electrically connecting said coaxial cable to an appliance, said coaxial cable comprising:

a core wire with an exposed end;

a shield wire; and an outer layer of insulation;

said connector comprising:

a conductive pin for electrically connecting said exposed end of said core wire to the appliance, said pin having an inner end contacting said exposed end of said core wire;

a conductive sleeve for electrically connecting said shield wire of said coaxial cable to the appliance, said sleeve surrounding said pin, said sleeve having a conductive spike piercing through said outer layer of insulation to contact said shield wire; and a pinching piece, said exposed end of said core wire being bent between said pinching piece and said inner end of said pin.

10. The combination of claim 9, further comprising an internal layer of insulation surrounding said core wire, said shield wire surrounding said internal layer of insulation, said outer layer of insulation surrounding said shield wire.

11. The combination of claim 10, wherein said outer layer of insulation, said shield wire, and said inner layer of insulation are stripped away from said exposed end of said core wire.

* * * * *